United States Patent [19]

Lilly et al.

[11] Patent Number: 4,926,758

[45] **Date of Patent: * May 22, 1990**

[54] PLAYTRAY WITH HINGED LEGS

[75] Inventors: Carol E. H. Lilly, Bellevue; Loyd C. Moore, Bellevue; Mark E. Eike, Bellevue; Nicholas E. Barker, Seattle, all of Wash.

[73] Assignee: Carol E. H. Lilly, Bellevue, Wash.

[ * ] Notice: The portion of the term of this patent subsequent to Oct. 10, 2006 has been disclaimed.

[21] Appl. No.: 185,737

[22] Filed: Apr. 25, 1988

Related U.S. Application Data

[63] Continuation-in-part of Ser. No. 136,117, Dec. 21, 1987, Pat. No. 4,872,410.

[51] Int. Cl.[5] ..... A47B 23/00

[52] U.S. Cl. ..... 108/43; 108/115

[58] Field of Search ..... 108/62, 43, 12, 44, 108/26, 13, 14, 17, 19, 33, 36, 123, 130, 131, 132, 55.3, 50; 446/128, 71

[56] References Cited

U.S. PATENT DOCUMENTS

| | | | |
|---|---|---|---|
| D. 252,979 | 9/1979 | Bayly . | |
| 2,956,849 | 10/1960 | Dow . | |
| 2,986,438 | 5/1961 | Smathers et al. . | |
| 3,148,636 | 9/1964 | Bloomquist et al. | 108/26 |
| 3,759,192 | 9/1973 | Oehler . | |
| 3,859,930 | 1/1975 | Sherwin . | |
| 3,939,976 | 2/1976 | VanIseghem Jr. | 108/50 X |
| 4,010,696 | 3/1977 | Priesman . | |
| 4,052,944 | 10/1977 | Jennings . | |
| 4,548,440 | 10/1985 | Meslin et al. | 108/26 X |
| 4,662,676 | 5/1987 | Havelock | 108/26 X |

FOREIGN PATENT DOCUMENTS

| | | |
|---|---|---|
| 817148 | 7/1969 | Canada . |
| 1049484 | 11/1966 | United Kingdom . |

*Primary Examiner*—Peter A. Aschenbrenner
*Attorney, Agent, or Firm*—Seed and Berry

[57] ABSTRACT

A foldable playtray is provided having a table top supported by a pair of legs hinged to the table top in one embodiment in such a way that both surfaces fo the table may be used. One surface of the table is provided with a Lego-type play surface so a child playing with Lego-type toys can detachably secure them to the table. The other surface of the table is flat, for use for games, arts and crafts. The legs can be rotated so they support the table with either its Lego-type play surface or its flat surface on top. In addition, the legs are provided with a Lego-type play surface and can be rotated to be coplanar with the table to provide an extended Lego-type play surface. The legs are also equipped with covered storage compartments for small objects. A storage bag and the table are provided with complimentary Velcro-type fasteners arranged in such a way that the Velcro can be used to not only attach the storage bag to the table, but they can also be used to close the storage bag when it is detached from the table. In a second embodiment, a pinch proof hinge, a remote single-handed operation latch mechanism and a carrying saddle bag are provided. The table top in this embodiment has only one usable side having a Lego-type play surface with a removable cover having a flat upper surface attachable to the play surface.

13 Claims, 9 Drawing Sheets

FIG.10
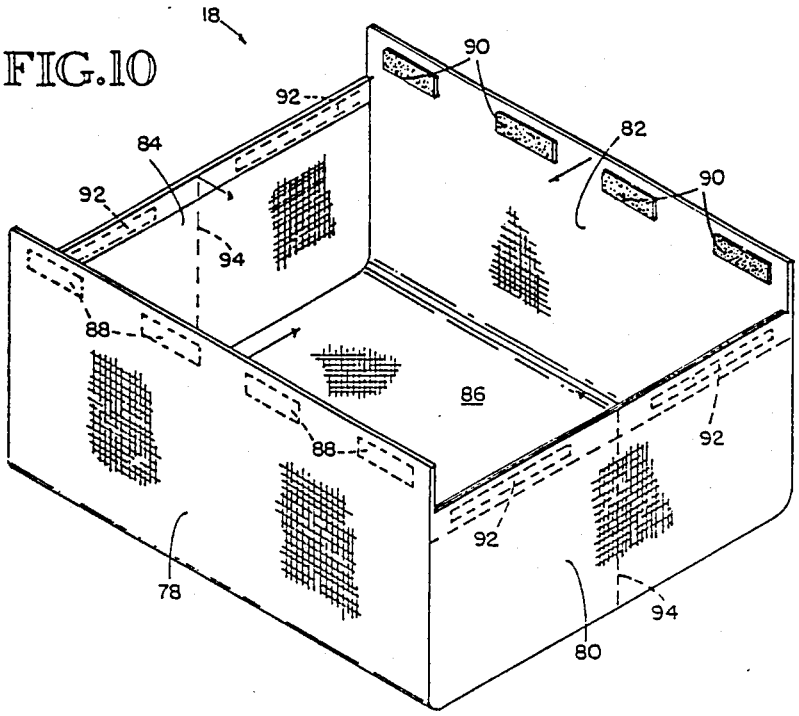
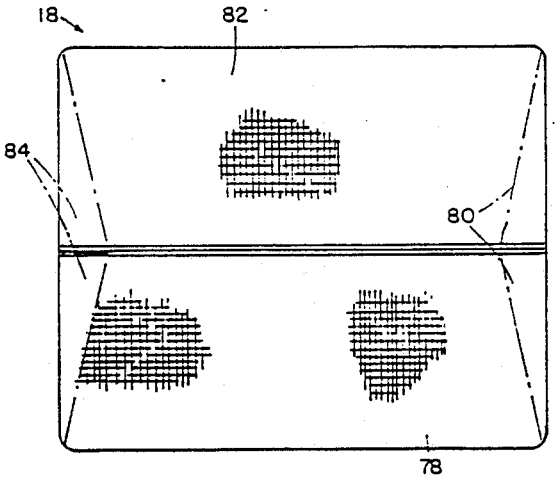
FIG.11

FIG.16
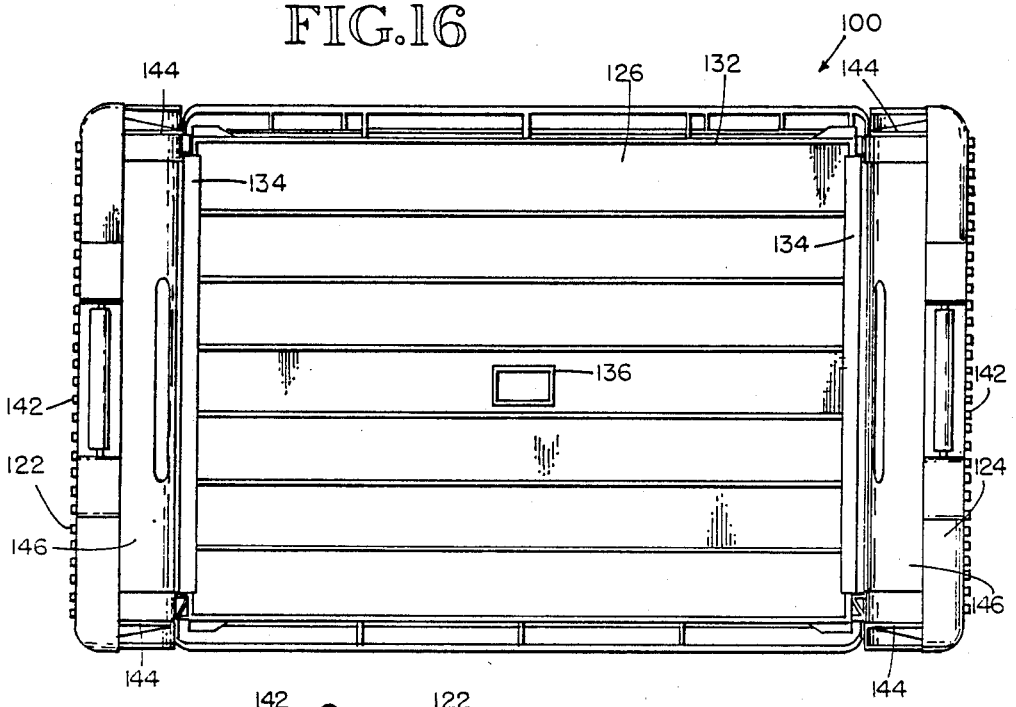
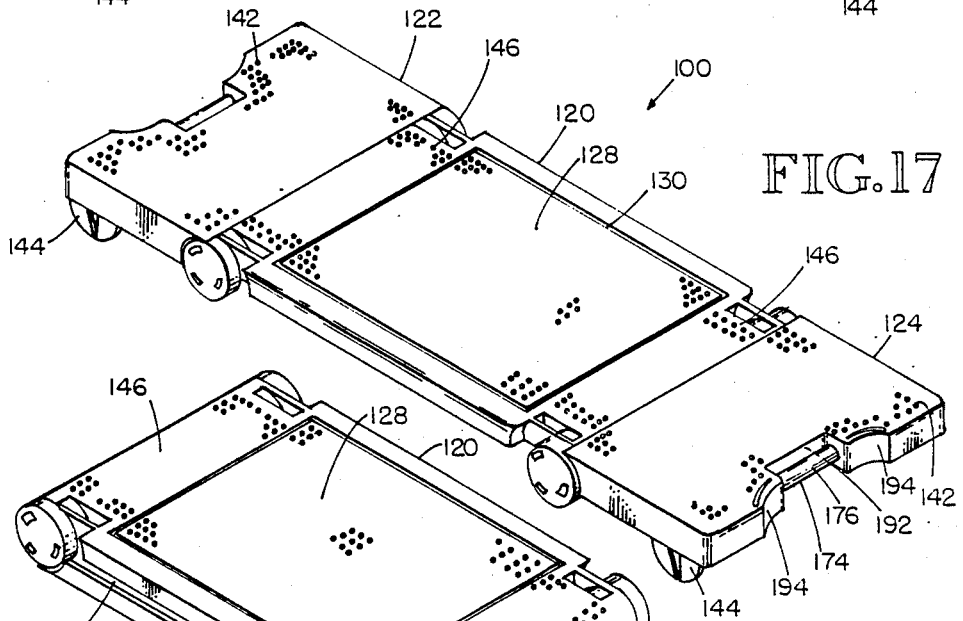
FIG.17
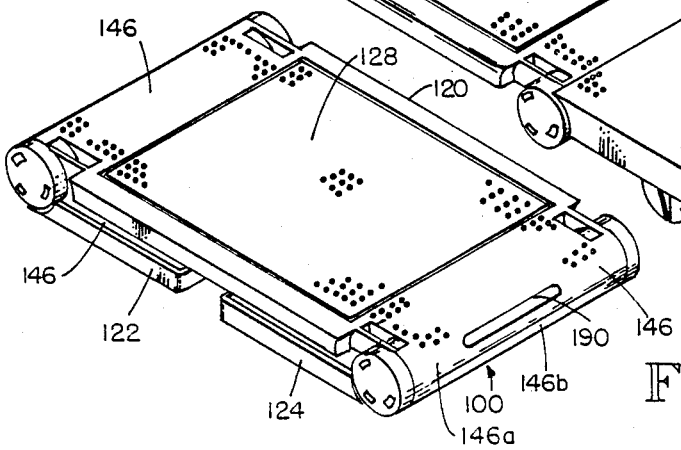
FIG.18

PLAYTRAY WITH HINGED LEGS

CROSS-REFERENCE TO APPLICATIONS

This application is a continuation-in-part application of U.S. Pat. Application Ser. No. 136,117 filed Dec. 21, 1987, now U.S. Pat. No. 4872410.

DESCRIPTION

1. Technical Field

The present invention relates to trays with legs, and more particularly, it relates to particular styles of such trays which are designed for use by children while engaged in certain play activities.

2. Background of the Invention

Certain types of building blocks and toys detachably snap together. Each such building block or toy is provided with a regular orthogonal array of cylindrical bumps or nubs on one surface and a corresponding regular orthogonal array of recesses on another surface. The nubs and recesses of the block or toy are adapted to engage and releasably hold the mating recesses and nubs, respectively, of another block or toy. Thus, by engaging nubs on one building block or toy with the recesses on another such building block or toy, the building blocks and toys can be detachably snapped together. Such building blocks and toys are very common and popular, and are sold under such brand names as Lego and Tyco. Also sold for use with such building blocks and toys are flat surfaces or base plates with nubs only on one side to use as a foundation for building.

For clarity and consistency of terminology, such building blocks and toys will be referred to hereafter as simply "Lego-type toys." Similarly, a flat surface or base plate covered by a regular array of such nubs or recesses will be referred to hereafter as simply a "Lego-type play surface." However, it is to be clearly understood that the terminology "Lego-type toys" and "Lego-type play surface" are not intended to be limited to the exact kinds of nubs and recesses found on existing Lego and Tyco snap-together building blocks and toys. Instead, such terminology is intended to include any type of building block or toy having complementary attachment means which permit the building blocks or toys to be detachably snapped together.

While flat base plates do exist for Lego-type toys, they are generally of very limited size and are very thin in nature thus providing a small and weak play surface. Even when using several such plates the combined plates lack rigidity and stability as a base for construction of larger size projects. Since the base plates are often used by children playing on the floor or carpet, the base plates frequently get stepped and knelt on causing them to break. Moreover, there are occasions when playing on the floor or carpet is not desirable, and an elevated play surface is preferred. The play surface should also be easily transportable when a Lego-type structure is attached. Existing base plates often flex when carried or moved causing the Lego-type building blocks to pop off. The present invention fulfills these needs, overcomes these disadvantages and provides other advantages.

DISCLOSURE OF THE INVENTION

In a first embodiment, the playtray of the present invention comprises a table top with a Lego-type play surface on a first side and a flat surface on an opposite second side. The table top is equipped with a pair of legs which are hinged to the table top in such a way that selectively allows both surfaces of the table top to be used.

In a first configuration, the legs are rotated at right angles with respect to the table top and support the table top with its Lego-type play surface on top, thereby enabling a child to comfortably sit with his or her legs extended beneath the table top, and to attach Lego-type toys to the Lego-type surface of the table top.

In a second configuration, the legs are rotated until they are coplanar with respect to the table top to provide an extended Lego-type play surface, since the one surface of each leg corresponding to the first side of the table top is also equipped with a Lego-type play surface.

In a third configuration, the table is turned over so the second side of the table top with the flat surface is on top. In this configuration, the legs of the table are rotated down until they are at right angles with respect to the table top and support it with the flat surface on top. In this configuration, the playtray may be used as a writing surface or as a play surface for puzzles, drawing, arts, crafts or games.

In a fourth configuration, the legs are rotated until they are coplanar with respect to the table top with a flat surface on top to provide an extended flat surface, since each leg is flat on its side opposite its side with the Lego-type play surface.

In a fifth configuration, the legs are both rotated to a position with the flat surface side against the flat surface side of the table top, for compact storage.

The legs are provided with storage compartments for small objects such as pens, pencils, crayons, etc., and are provided with doors to keep the stored objects secure until needed. The doors open outwardly for easy access when the playtray is in its third and fourth configurations. The exterior side of the doors provide the flat surfaces of the legs.

In the first embodiment, the playtray is equipped with a detachable storage bag for Lego-type toys or other objects. The storage bag is secured to the table by Velcro-type fasteners. A first perimeter side wall of the table top has a hook-type Velcro fastener, while a second opposite perimeter side wall of the table top has mating loop-type Velcro fasteners. The storage bag has just the opposite arrangement of Velcro fasteners. That is, it has loop-type Velcro fasteners along one upper side wall, and hook-type Velcro fasteners on an opposite upper side wall at the mouth of the bag's opening to correspond to the table top. This arrangement of Velcro fasteners permits the storage bag to be secured to the table top when the playtray is not in use, with the storage bag being located neatly beneath the table and between its legs. This arrangement of Velcro fasteners also permits the Velcro fasteners on the storage bag to engage each other to close the storage bag neatly and securely should the storage bag be removed from the playtray for any reason.

In a second embodiment, the playtray comprises a table top having first and second end portions and a table play surface with attachment means on the table play surface corresponding to the attachment surface of the toys or blocks with which it is used. The playtray further includes a first leg having a first leg play surface with attachment means on the first leg play surface corresponding to the attachment surface of the toys or blocks. A first hinge means is provided for pivotally attaching the first leg to the table top first end portion. A second leg is provided with a second leg play surface with attachment means corresponding to the attachment surface of the toys or blocks. A second hinge means is provided for pivotally attaching the second leg to the table top second end portion.

The playtray also includes a first and second latch means for latching the first and second legs, respectively, against movement relative to the table top in at least first and second leg configurations. In the first leg configuration each of the latch means latches the corresponding one of the legs in a position with the first and second legs extending generally transverse to the table top in a common direction to support the table top with the table play surface uppermost. In the second leg configuration each of the latch means latches the corresponding one of the legs in a position with the first and second legs extending away from the table top in generally opposite directions in a plane generally parallel with the table top. This positions the table play surface and the first and second leg play surfaces in generally coplanar arrangement to define an extended play surface.

The first and second latch means are also provided for latching the first and second legs to the table top in a third leg configuration wherein the first and second legs are folded inward under the table top with an underside surface of the first and second legs in juxtaposition with an underside surface of the table top.

The attachment means of the table play surface and the first and second leg play surfaces cover the surfaces such that when the legs are in the second leg configuration, the attachment means in combination define a substantially unbroken play surface. The play surface extends substantially fully between a free end of the first leg and a free end of the second leg.

In this second embodiment of the invention, the first and second hinge means include a pair of cylindrical hinge portions fixedly attached to the first and second end portions of the table top and spaced apart along and in axial alignment with a hinge rotation axis extending generally transverse to the table top. Each of the hinge portions has a side wall substantially circular in cross-section with an outwardly open end defining an outer edge wall and a transverse interior wall spaced inward from the open end. The interior wall has a plurality of apertures therein.

The first and second hinge means further include a pair of hinge rings fixedly attached to each of the first and second legs at an end portion thereof and spaced apart along and in axial alignment with the hinge rotation axis. The pair of hinge rings are spaced apart to position the pair of hinge rings outward of the corresponding pair of the table top hinge portions with an inner edge wall of each of the hinge rings in juxtaposition with and substantially contacting a corresponding one of the outer edge walls of the table top hinge portions. The hinge rings and the edge walls of the table top hinge portions have a substantially equal sized wall thickness and diameter.

The first and second hinge means also includes a connector cap having a sleeve with a substantially circular cross-section. The sleeve has a diameter that fits snugly interior of the corresponding adjacent pair of the hinge ring and table top hinge portion, and a length to span the hinge ring and table top portion in the direction of the hinge rotation axis. The connector cap further includes an end cover with a generally circular portion in juxtaposition with and substantially contacting an outer edge wall of a corresponding one of the hinge rings to close the interior of the hinge ring.

The connector cap also includes a plurality of arms positioned inward of the sleeve and extending into the apertures in the transverse interior wall of the corresponding one of the table top hinge portions and grasping the interior wall to hold the connector cap against movement relative thereto. The connector cap and the table top hinge portion hold the hinge ring rotatably therebetween on the sleeve for rotational movement of a corresponding one of the legs about the hinge rotation axis relative to the table top.

The first and second latch means includes latch grooves formed in each of the first and second end portions of the table top corresponding in position and number to the leg configurations for the playtray . The latch grooves are provided for latching the legs in their various leg configurations. The latch means further includes a pair of latches movably attached to each of the first and second legs. Each latch has a handle portion positioned at an end portion of the corresponding one of the legs and operable by the user, and a catch portion positioned to releasably engage the latch grooves of the corresponding one of the first and second end portions of the table top for selectively locking the legs in the leg configurations and releasing the legs for movement between the configurations. The latch further includes an extension portion extending between the handle portion and the catch portion for moving the catch portion into and out of the grooves in response to movement of the handle portion. A spring means is provided for biasing the catch portion into the grooves when the handle portion is released by the user.

In order to provide a smooth surface for writing or play, the playtray of the second embodiment includes an alternative surface member having a first flat side for use by the user and a second opposite side with attachment means corresponding to the attachment means of the table play surface for detachably fastening the cover to the table play surface with the cover flat side facing outward.

The first and second legs of the play table are further provided with at least one fixed support projecting away from an underside surface thereof to support the legs in an elevated position above a surface on which the playtray is placed when the legs are in the second leg configuration. The supports also provide a gap between the Lego and the table top when folded into the third configuration.

Finally, the invention includes a saddle bag for storage of the playtray. The saddle bag includes a first storage compartment for toys or blocks and a second storage compartment for additional materials. The first and second storage compartments are spaced apart to define a space therebetween sized to hold the playtray therein when in the folded third leg configuration. A connector member extends between the first and second storage compartments along a lower edge thereof to define a lower extent of the space and to extend below the playtray when in the space. The connector member carries the weight of the playtray when the saddle bag is lifted and ties the compartments together. The saddle bag further includes side connector means for releasably connecting the opposing side portions of the storage compartments together and holding the playtray in the space against lateral movement, and a top connector means for releasably connecting the top portion of the storage compartments together and holding the playtray in the space against upward movement.

The foregoing is intended to be a brief summary of, not a detailed catalog of, the various objects, features, advantages and characteristics of the playtray of the present invention, since these and other objects, features, advantages and characteristics of the present invention will be expressly or inherently disclosed to those skilled in the art to which it pertains in view of all of the disclosures contained in this document.

BRIEF DESCRIPTION OF THE DRAWINGS

FIG. 10 is a perspective view of the playtray's storage bag in an open configuration shown removed from the playtray;

FIG. 11 is a top plan view of the playtray's storage bag in a closed configuration, shown removed from the playtray;

FIG. 16 is an enlarged bottom plan view of the playtray of FIG. 12 showing an alternative surface stored beneath the table top;

FIG. 17 is a perspective view of the playtray of FIG. 12 in a second configuration with its legs outstretched to form an extended Lego-type play surface;

FIG. 18 is a perspective view of the playtray of FIG. 12 in the third configuration with its legs folded into a compact position for storage or lap top use;

BEST MODE FOR CARRYING OUT THE INVENTION

Figure 1:
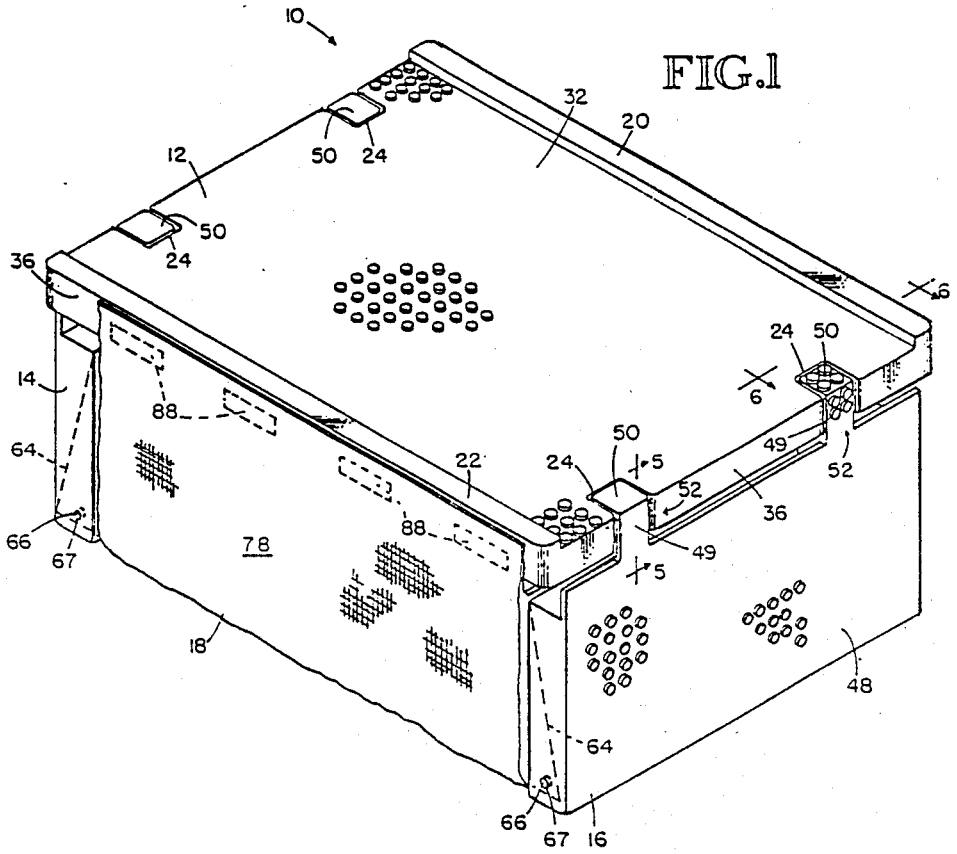
FIG. 1 is a perspective view of a first embodiment of a playtray of the present invention in a first playing configuration with its storage bag attached.

Turning now to FIG. 1, a first embodiment of the playtray of the present invention is generally designated by the reference numeral 10 and comprises four major components, namely, a table top 12, a pair of storage legs 14 and 16, and a storage bag 18.

Figure 5:
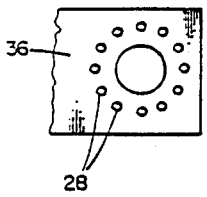
FIG. 5 is an enlarged partial elevational view taken substantially along line 5—5 of FIG. 1.
Figure 6:
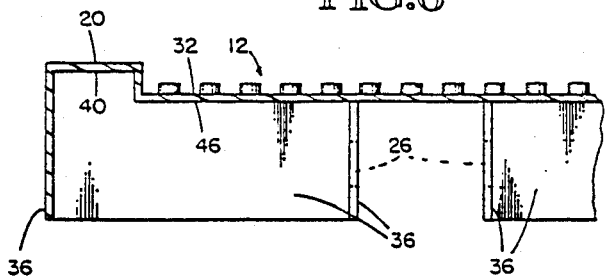
FIG. 6 is an enlarged partial cross sectional view taken substantially along line 6—6 of FIG. 1, with the storage leg shown detached.

Table top 12 has a pair of flat-topped, raised edges 20, 22; four hinge recesses 24, and a Lego-type play surface 32 on a first side thereof. As best seen in FIG. 5, a circular hinge hole 26, which is surrounded by a circular array of hemispherical latching recesses 28, is provided in both opposed sides of each hinge recess 24. The Lego-type play surface 32 of the table top 12 extends fully between edges 20 and 22, and also extends the full length of table top 12.

Figure 3:
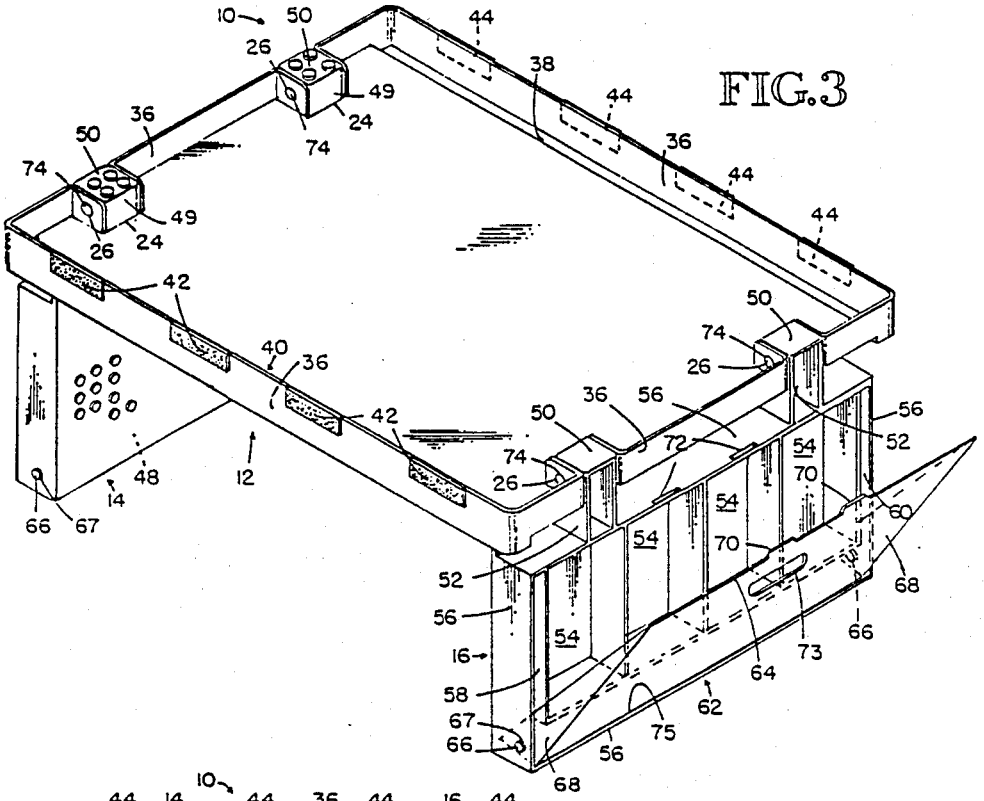
FIG. 3 is a perspective view of the playtray of FIG. 1 turned over to position it in a third playing configuration with its flat side up and with its storage bag removed.

As best seen in FIG. 3, table top 12 is completely surrounded by a peripheral reinforcing edge wall 36 which projects away from the Lego-type play surface and is continuous except where broken at the inner edge of each hinge recess 24. Table top 12 is preferably formed of plastic of relatively uniform thickness, and a pair of pencil trays 38 and 40 are formed by the underside of raised edges 20, 22. The trays are usable when the playtray is inverted as shown in FIG. 3. The peripheral edge wall 36 of table top 12 is provided with patches of loop-type Velcro 42 on one side and with patches of hook-type Velcro 44 on the other side. Each patch of Velcro 42, 44 is affixed to the peripheral edge wall 36 by any conventional means, such as by gluing, and is preferably located in a respective shallow recess in peripheral edge wall 36 to help prevent its edges from being snagged, which might cause it to be accidentally torn off. A second side of table top 12 opposite the first side with the Lego-type play surface 32 has a flat play surface 46.

Turning now to a consideration of the playtray's storage legs 14 and 16, and as best seen in FIG. 1, a top surface 48 of each storage leg is completely covered with a Lego-type play surface; as are the top and end surfaces 49 and 50 of each of a pair of hinge arms 52 which pivotally attach each of the legs to the table top 12.

Figure 7:
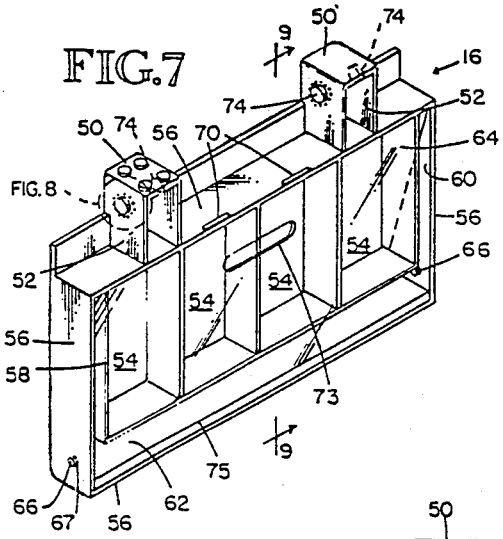
FIG. 7 is a perspective view of one of the playtray's storage legs showing its storage compartments and door on the opposite side from the Lego-type play surface of the leg.
Figure 9:
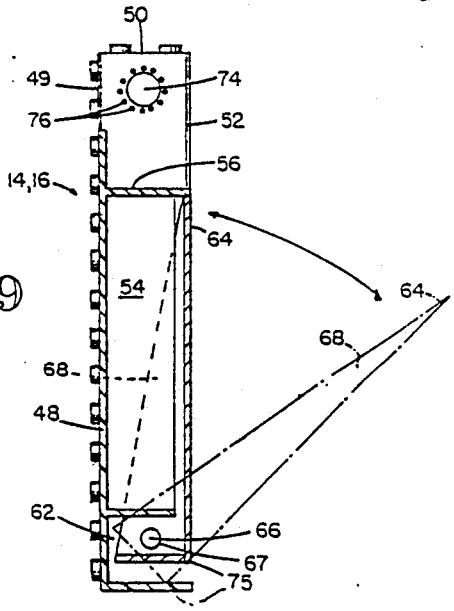
FIG. 9 is an enlarged cross sectional view taken substantially along line 9—9 of FIG. 7.

Referring now to FIGS. 3, 7 and 9, each storage leg 14, 16 includes several storage compartments 54 which are separated from a peripheral wall 56 of storage leg 14, 16 by side recesses 58, 60 and by bottom recess 62.

Each storage leg 14, 16 includes a cover 64 having a pair of hinge pins 66 which are received in corresponding hinge holes in the peripheral wall 56 of its corresponding storage leg 14 or 16. When cover 64 is closed (see FIG. 7), its sides 68 fit into the side recesses 58, 60, while a pair of latch ears 70 hold it securely closed by fitting into corresponding latch slots 72 in peripheral wall 56.

A finger hole 73 is provided in each cover 64, so the user can conveniently pull cover 64 open as desired. As best seen in FIGS. 3 and 9, rotation of cover 64 is preferably stopped by the bottom front edge 75 of cover 64 contacting the bottom portion of peripheral wall 56 when cover 64 is opened to about a 45° angle with respect to storage leg 14, 16. If desired, the bottom front edge 75 of cover 64 could, of course, be made rounded enough to permit cover 64 to open at a right angle with respect to storage leg 12, 14. In addition, a retaining wall could be located across the lower portion of each storage compartment 54, to prevent stored articles from spilling out when cover 64 is opened.

Figure 8:
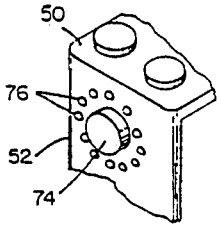
FIG. 8 is an enlarged partial perspective view showing the hinge and latch arrangement on the playtray's storage legs.

As best seen in FIGS. 7–9, the two sides of each hinge arm 52 of storage legs 14, 16 are each provided with a hinge pin 74 surrounded by a circular array of hemispherical detents or latch bumps 76. Each hinge pin 74 is received in a corresponding one of the hinge holes 26 in the table top 12 located on opposite sides of each hinge recess 24. Similarly, each latch bump 76 is releasably received in a corresponding latch recess 28 in table top 12 as storage legs 14, 16 are rotated with respect to table 12 into the different configurations seen in FIGS. 1–4. Latch bumps 76 and latch recesses 28 are, of course, arranged to releasably lock storage legs 14, 16 into the various positions with respect to table top 12, which are seen in FIGS. 1–4. It is to be understood that the hinge and latch mechanism 74, 76, 26, 28 is conventional, and may be replaced with any conventional hinge and latch mechanism which will releasably lock storage legs 14, 16 into the various configurations seen in FIGS. 1–4.

Table top 12, storage legs 14, 16 and covers 64 are each preferably molded separately each as one piece from any strong, durable, crack-resistant plastic, although they could also, of course, each be molded as several component pieces which would then be assembled and fastened together in any suitable conventional way. In addition, the plastic used must be resilient enough to permit the insertion of hinge pins 66 of covers 64 into their corresponding hinge holes, to permit latch ears 70 on covers 64 to be releasably engaged by latch slots 72, to permit hinge pins 74 of storage arms 14, 16 to be inserted into hinge holes 26 in table top 12, and to permit latch bumps 76 on storage legs 14, 16 to be releasably received by latch recesses 28 in table top 12.

Turning now to FIG. 10, storage bag 18 is preferably sewn, in an conventional fashion, from cloth, and has sides 78, 80, 82, 84 and a bottom 86. Sewn to the inside of the top portion of side 78 are hook-type Velcro patches 88 (adapted to mate with the loop-type Velcro patches 42 on table top 12); while sewn to the inside at the top portion of the opposing side 82 are loop-type Velcro patches 90 (adapted to mate with the hook-type Velcro patches 44 on the table top 12). Sewn into the top edge folds of the other two sides 80, 84 are stays 92.

When storage bag 18 is removed from table top 12 and is to be closed, its sides 78, 80, 82, 84 are moved toward each other in the directions indicated by the arrows in FIG. 10. Because of stays 92, the sides 80, 84 bend inwardly along fold lines 94 until Velcro patches 88, 90 can mate with each other, thereby securely closing the storage bag 18, as seen in FIG. 11.

Storage bag 18 is preferably made of a thin, strong, flexible material, such as cloth or plastic, to enable it to be closed in the manner just described. In addition, such a construction allows the child to more easily sort through the Lego-type toys without having to remove them from storage bag 18. However, it could be made from a stiff, rigid material, if such features were not desired. Similarly, although Velcro patches 42, 44, 88, 90 on table top 12 and storage bag 18 are preferred, any other conventional releasable fastening means could be used, such as snaps, etc.

As has been mentioned, the playtray 10 of the present invention has several playing configurations. In FIG. 1, the storage legs 14, 16 are folded down to support the table top 12 in an elevated position with its Lego-type play surface 32 uppermost. As seen in FIG. 1, since the end surfaces 50 of the hinge arms 52 of the storage legs 14, 16 have a Lego-type play surface, the Lego-type play surface 32 of the table top 12 is essentially unbroken. Storage bag 18 can be removed from table 12 by disengaging Velcro patches 42, 44, 88, 90 from each other, such as when access to the Lego-type toys or other articles stored therein is desired. In addition, removal of storage bag 18 permits the user to comfortably extend his or her legs under table top 12 while using playtray 10.

Figure 2:
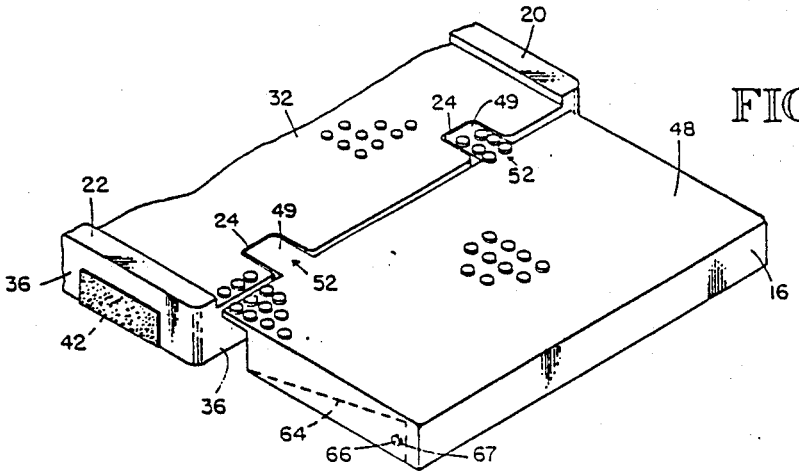
FIG. 2 is a partial perspective view of the playtray of FIG. 1 in a second playing configuration with its storage bag removed and with its storage legs outstretched to form an extended Lego-type play surface.

FIG. 2 illustrates the manner in which, when the storage bag 18 is removed, both of the storage legs 14, 16 can be rotated out horizontally to create an extended coplanar Lego-type play surface comprised of surface 32 of the table top 12, surface 48 of the storage leg 14, 16, and surface 49 of the hinge arms 52. Here, again, since the top surface 49 of the hinge arms 52 of storage legs 14, 16 are equipped with a Lego-type play surface, said extended Lego-type play surface 32, 48 and 49 is essentially unbroken.

In FIG. 3, the playtray 10 has been turned over and its storage legs 14, 16 rotated 180° with respect to their position seen in FIG. 1, so the flat bottom surface of the table top 12 can be used for any desired activity, such as drawing, eating, etc. Here, again, storage bag 18 could be secured to playtray 10 by mating Velcro patches 42, 44, 88, 90; or it could be removed, as seen, to permit access to its contents or to permit the user to comfortably extend his or her legs under table top 12 while using playtray 10.

Figure 4:
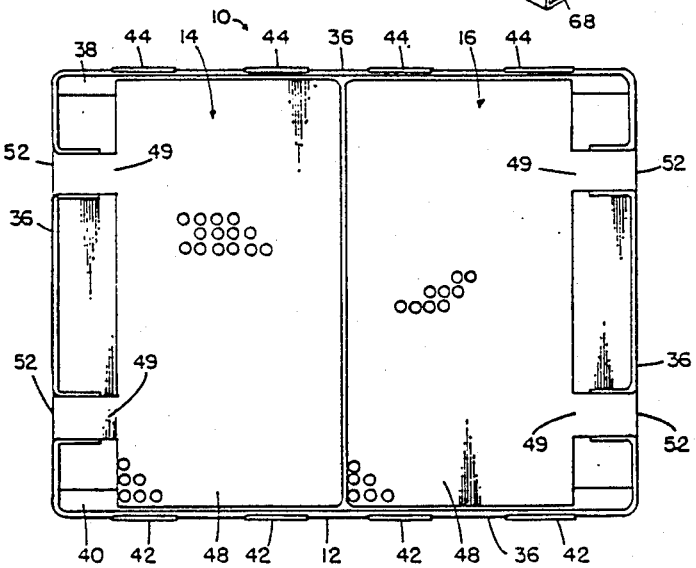
FIG. 4 is a bottom plan view of the playtray; of FIG. 1 with its storage bag removed and with its storage legs folded into a compact position for storage or lap top use.

In FIG. 4, playtray 10 has been folded up for storage or lap top use by rotating its storage legs 14, 16 inward against flat surface 46 of the table top 12.

Figure 12:
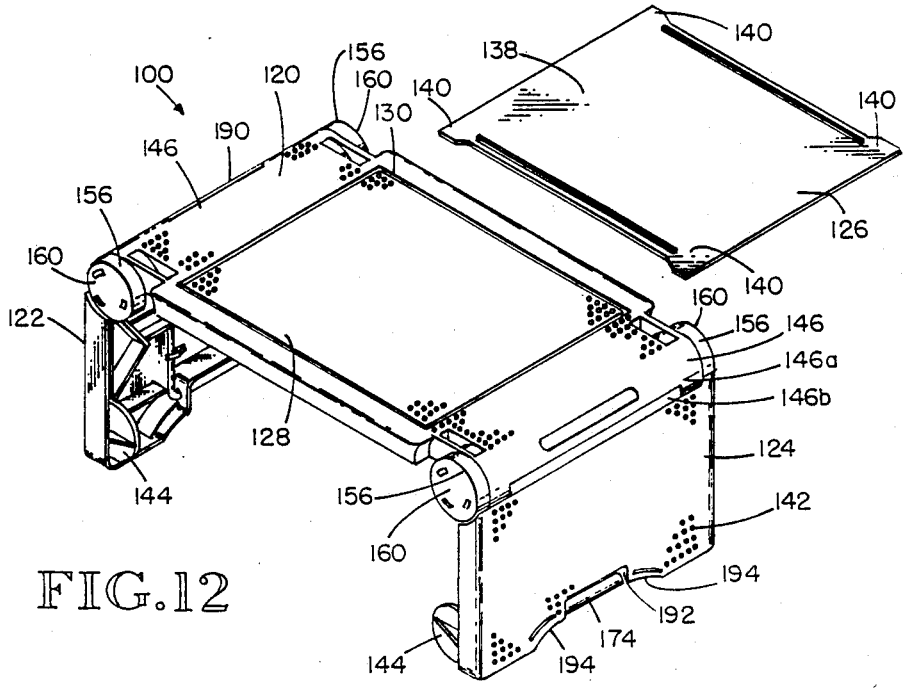
FIG. 12 is a perspective view of a second embodiment of the playtray of the present invention in a first configuration shown with a flat surface cover positioned for attachment to the Lego-type play surface.
Figure 13:
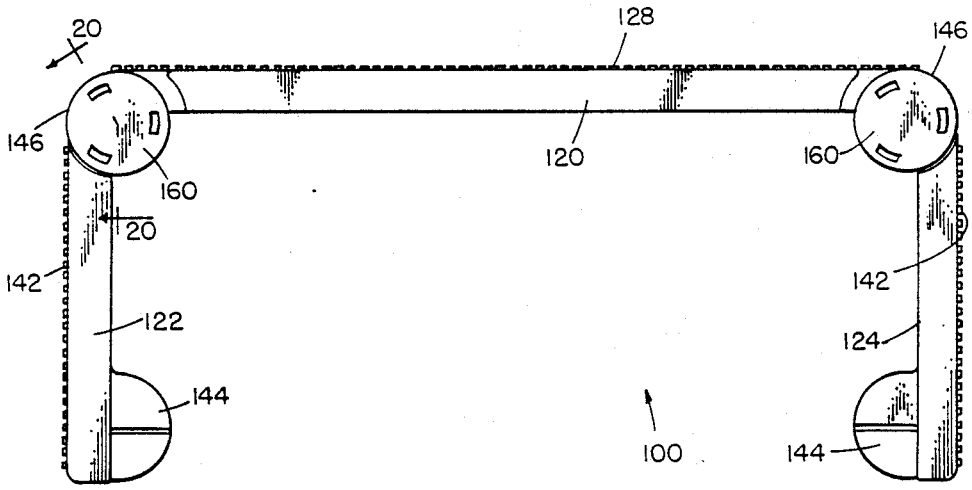
FIG. 13 is an enlarged front and elevational view of the playtray of FIG. 12.
Figure 14:
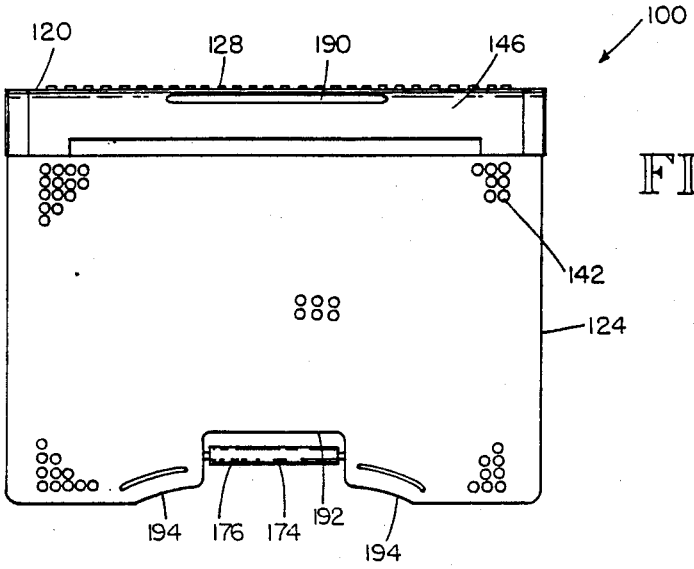
FIG. 14 is an enlarged side elevational view of the playtray of FIG. 12.
Figure 15:
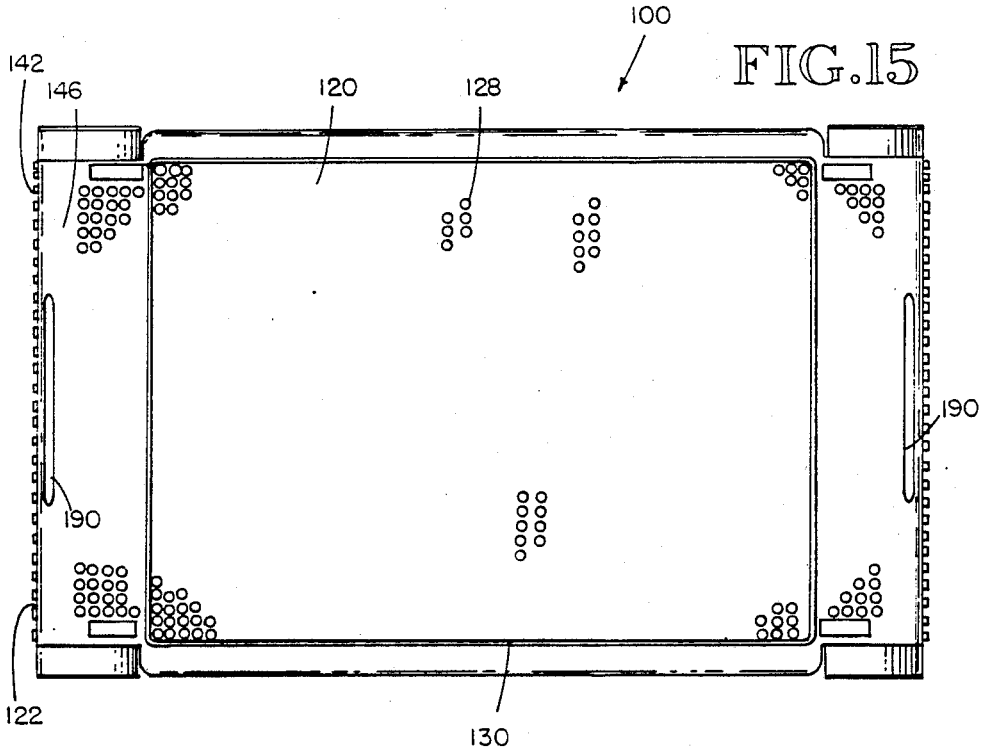
FIG. 15 is an enlarged top plan view of the playtray of FIG. 12.

A second embodiment of the playtray, generally designated by the reference numeral 100, includes a table top 120, a pair of play surface legs 122 and 124 pivotally attached at the opposite left and right ends of the table top (as viewed in FIG. 12), and a removable alternative surface 126. In this embodiment, the table top 120 has a planar first side with a Lego-type play surface 128 extending over most of the first side, as will be described in more detail below. The table top 120 includes a continuous groove 130 extending about the perimeter of the first side of the table top, spaced inward from the outer edges thereof. The groove 130 is generally rectangular in shape and sized to receive therein a correspondingly shaped attachment wall 132 of the alternative surface 126 which projects downward from the underside of the alternative surface. The attachment wall 132 of the alternative surface 126 is best illustrated in FIG. 16 which shows the alternative surface in the storage position held to the underside of the table top 120 by a pair of L-shaped brackets 134 positioned toward opposite ends of the table top. The brackets 134 are fixedly attached to the underside of the table top.

The underside of the alternative surface 126 further includes a downwardly projecting attachment wall 136 of smaller outer diameter than attachment wall 132 which is positioned toward the center of the alternative surface. The smaller attachment wall 136 is sized to mateably engage the Lego-type play surface 128 of the first side of the table top 120.

As previously described for the first embodiment of the invention, the playtray 100 provides a Lego-type play surface 128 for the table top 120 so that Lego-type toys can be removably attached thereto by the user. However, unlike the first embodiment, this second embodiment utilizes a alternative surface 126 which is removably attachable to the table top to provide a smooth surface for writing and play. The alternative surface 126 has a flat upper surface 138 which can be used for any desired activity requiring a flat surface. The alternative surface is conveniently removable and storable immediately under the table top using the L-shaped brackets 134. The alternative surface 126 has a corner tab 140 at each corner sized for grasping with the fingers to facilitate removal of the alternative surface when attached to the Lego-type play surface 128. The alternative surface 126 is held securely in place against rotation relative to the table top or unintended removal as a result of the attachment wall 132 of the alternative surface being positioned in the groove 130 of the table top 120, and the attachment wall 136 being grasped by the Lego-type play surface 128 of the alternative surface.

In this second embodiment of the invention, the play table 100 utilizes only three configurations for the legs 122 and 124. In FIGS. 12-16, the playtray 100 is shown with the legs 122 and 124 folded down to support the table top 120 in an elevated position with its Lego-type play surface 128 uppermost. A second configuration is illustrated in FIG. 17 in which both of the legs 122 and 124 are rotated out horizontally coplanar with the table top 120. Each of the legs has a top surface 142 covered with a Lego-type play surface. When in the configuration of FIG. 17, the playtray 100 provides an extended coplanar Lego-type play surface comprised of the table top surface 128 and the two leg surfaces 142. The Lego-type play surfaces 128 and 142 extend over the length of the table top 120 and the legs 122 and 124 a sufficient distance so that when in the second configuration of FIG. 17, the Lego-type play surfaces are positioned to provide a continuous play surface with the nubs of each of the Legotype play surfaces matching to provide a generally continuous regular orthogonal array of nubs. It is noted that the Lego-type play surface 128 of the table top extends forwardly and rearwardly only within the boundary described by the groove 130, however, extends along the length of the table top sufficiently beyond the groove 130 to be positioned adjacent to and in alignment with the nubs forming the Lego-type play surfaces 142 of the legs 122 and 124 when the legs are rotated into the second configuration of FIG. 17.

To facilitate maintaining the coplanar arrangement of the Lego-type play surfaces 128 and 142 when the playtray 100 is in the second configuration of FIG. 17 and resting upon a floor or table, each of the legs 122 and 124 is provided with a pair of fixed, downwardly projecting support spacers 144 positioned at each corner of the legs toward its free end. Support spacers 144 project downwardly sufficient length to maintain the legs 122 and 124 in generally parallel arrangement with and spaced above the surface on which the playtray is resting. The support spacers 144 hold the legs above the surface by the same distance as the table top is held above the surface by a pair of cylindrical end portions 146 of the table top. The cylindrical portions 146 also serve as part of the hinge mechanism which pivotally attaches the legs 122 and 124 to the table top 120, as will be described in more detail below.

A third configuration of the play table 100 is shown in FIG. 18 with the legs 122 and 124 folded up for storage or lap top use by rotating the legs inward with their underside toward the underside of the cover 126 which is stored under the table top 120. To avoid pinching the user's fingers when the legs are placed into this folded up position, the support spacers 144 are positioned to space the underside of the legs 122 and 124 away from the underside of the cover 126 and thus provide a gap 148 therebetween sized large enough that the fingers of at least a child will not be pinched if inadvertently extending into the gap that is formed when the legs are folded.

It is noted that in this second embodiment of the invention, no attachable storage bag is utilized. Furthermore, the legs 122 and 124 do not contain covered storage compartments. It should be understood, however, that a storage bag and storage compartments similar to those of the first embodiment could be utilized if desired with the second embodiment of the invention.

Figure 20:
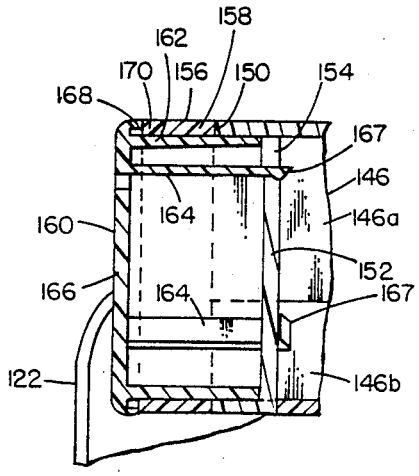
FIG. 20 is an enlarged partial cross-sectional view taken substantially along line 20—20 of FIG. 13.

The hinge mechanism of the second embodiment of the invention is substantially improved over the hinge arms used with the first embodiment so as to now include the safety feature of being pinch proof. In other words, even the small fingers of children cannot be pinched in the hinge mechanism as the legs 122 and 124 are rotated between the three leg configurations for the play table 100. As noted above, each end of the table top 120 comprises a cylindrical portion 146. The cYlindrical portion 146 has a forward end and a rearward end each referred to by the reference numeral 150. As best shown in FIG. 20, the cylindrical member 146 is generally hollow except for a transverse wall 152 positioned slightly inward from each of the forward and rearward ends 150. The transverse wall 152 has three circumferentially spaced apart slots 154 therein.

Figure 19:
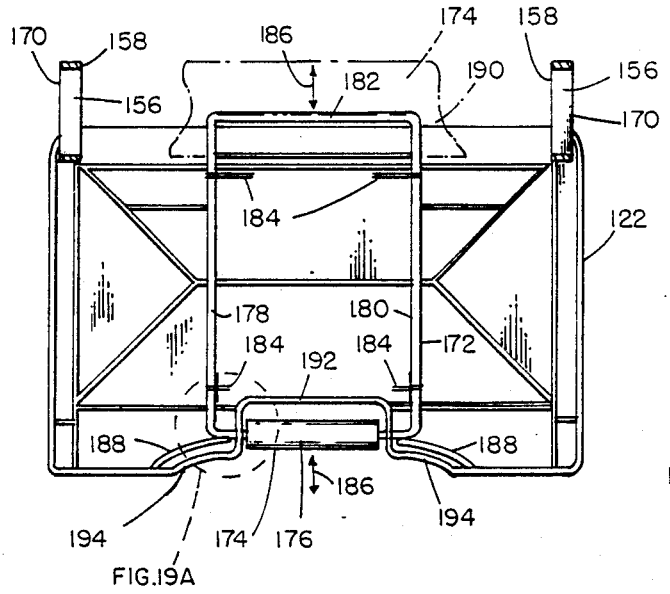
FIG. 19 is a partial side elevational view of the playtray of FIG. 12 showing the underside of one of the legs.
Figure 19A:
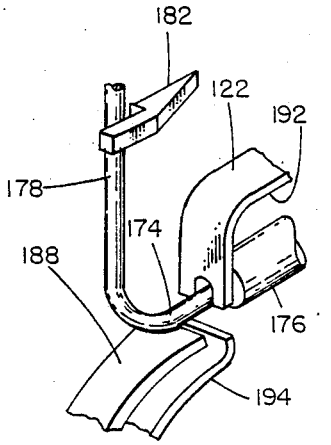
FIG. 19A is an enlarged partial perspective view of the portion of the latch mechanism shown in the circled portion of FIG. 20.

As best shown in FIG. 19 for the leg 122, each of the legs 122 and 124 has formed as an integral part thereof a pair of hinge rings 156 spaced apart toward the forward and rearward portions of the leg by a distance substantially equal to the length of the cylindrical member 146 of the table top 120. Upon assembly, the attachment rings are positioned with an inward edge 158 thereof in contact with an outer edge of the outer end 150 of the cylindrical member 146 with substantially no gap therebetween. The hinged or pivotal connection of the attachment rings 156 of the legs 122 or 124 to the cylindrical member 146 of the table top 120 is facilitated by an end cap 160.

The end cap 160 has a sleeve 162 with an outer diameter substantially equal to the inner diameter of the attachment ring 156 of the legs and the outer end 150 of the cylindrical member 146 and is positioned radially inward of both the attachment ring and the cylindrical member. The cap is anchored in place relative to the table top 120 by three hook arms 164 which are attached to the inside of a head portion 167 of the cap 160 and project inwardly toward the transverse wall 152 of the cylindrical member 146. Each of the hook arms extends through and beyond one of the three slots 154 in the transverse wall 152. A free end portion 166 of each of the hook arms 164 has a hook portion which is biased by the natural resiliency of the hook arm to engage the inward side of the transverse wall 152 to lock the cap 160 in position relative to the table top 120 and prevent its movement relative thereto. The sleeve 162 of the cap 160 has a length to reach substantially to the transverse wall 152 when the cap is locked in position in the cylindrical member 146.

The head portion 167 of the cap 160 is provided with a circumferential sidewall 168 which, when the cap is locked in position, is in contact with an outer edge wall 170 of the attachment ring 156 of the corresponding leg 122 or 124 and holds the attachment ring tightly between the cap sidewall 168 and the outer end 150 of the cylindrical member 146. Again, substantially no gap is provided between the parts, thus when the attachment ring 156 of the leg rotates relative to the cap 160 and the cylindrical member 146, as it rides on the sleeve 162 of the cap, it is impossible for the user to pinch his fingers in the hinge mechanism. The head portion 167 also serves as a closure for the interior space of the attachment ring 156 and the cylindrical member 146.

The hinge mechanism of the present invention provides a very secure and durable hinge having a smooth, aesthetically pleasing exterior appearance. It is noted that in this second embodiment of the invention, the cylindrical member 146 is comprised of a portion **146*a* molded integral with the table top 120 and an elongated central portion 146*b* having a semicircular cross-section which is snap fitted or glued upon assembly to the integrally formed portion 146*a*, thus facilitating manufacture of the playtray 100**.

As noted above, the legs 122 and 124 of the playtray 100 of this second embodiment of the invention have three leg configurations which require the legs to be rotated between three positions and produce a total rotation of each leg of approximately 180° as it is rotated from the extended position of FIG. 17 to the folded up position of FIG. 18. To maintain the legs 122 and 124 locked in the position to which the user moves them, the playtray 100 is provided with a latching mechanism for each leg. The latching mechanism is identical for each leg, and as best shown in FIG. 19 includes a rectangularly loop-shaped rigid latch rod 172. The latch rod 172 has a handle portion 174 covered with a soft hand grip 176, and a pair of spaced apart extension portions 178 and 180 which are each attached by one end to opposite ends of the handle portion 174 and are attached by an opposite end to opposite ends of a catch portion 182 of the latch rod.

The extension portions 178 and 180 are each slidably retained by two retainers 184 projecting downward from the underside of the leg 122 or 124 for which the latch mechanism is mounted. The retainers 184 allow the latch rod 172 to be moved in or out in the direction of the arrows 186 shown in FIG. 19. A pair of lever springs 188 are integrally formed as a part of each of the legs 122 and 124 and apply a biasing force on the handle portion 174 to bias the latch rod 172 inward toward the cylindrical member 174 of the table top 120. As will become clear from the description which follows, this biasing force biases the latch rod 172 into a latched position to maintain the leg in one of its three configurations to which it has been rotated by the user.

The cylindrical member 174 is provided with three longitudinally extending grooves 190, with each of the three grooves circumferentially positioned on the cylindrical member to correspond to one of the three configurations for the leg 122 or 124. When the leg is rotated to place it in one of the three configurations, one of the grooves 190 will be positioned to receive therein the catch portion 182 of the latch rod 172 and thus prevent rotation of the leg from the desired position until released by the user. The catch portion 182 is held within the groove 190 by the inward biasing force applied by the lever springs 188.

The user may conveniently unlatch the leg 122 or 124 being held in position by the latch mechanism with a one handed operation by grasping the handle portion 174 of the latch rod 172 and pulling outward with sufficient force to overcome the spring force of the lever springs 188. This withdraws the catch portion 182 of the latch rod out of the groove 190 in which it is positioned. The leg may then be easily rotated into one of the other two configurations which as is desired. When the leg is rotated into the desired configuration, the user simply releases the handle portion 174 of the latch rod 172 and the lever springs 182 move the catch portion 182 into the groove 190 corresponding to that configuration. This will hold the leg in position until the user again desires to release the catch portion 182. Alternatively, the user may release the handle portion 174 as soon as the catch portion 182 is clear of the groove 190 it was in and the catch portion will simply slide over the rounded surface of the cylindrical member 146 until the next groove is encountered. The lever springs will then force the catch portion into the encountered groove.

To facilitate easy grasping of the handle portion 174 of the latch rod 172, the handle portion is positioned in a cut-away recess 192 at the free end of the leg 122 or 124 with which it is associated. Adjacent to each side of the recess 192 is a curved end wall portion 194 of the leg 122 or 124. The user may place the palm of his or her hand on one of these curved portions 194 to apply the necessary counter force needed when the user grasps the handle portion 174 of the latch bar 172 in his fingers and pulls outward thereon to release the catch portion 182. The latch mechanism permits single-handed operation of the latch mechanism remote from the vicinity of the hinge mechanism described above. In addition to being convenient, this also keeps the hands of the user away from the hinge mechanism and other parts of the playtray 100 which might be moving relative to each other as the legs are rotated, thus minimizing the chances for fingers to be pinched.

Figure 21:
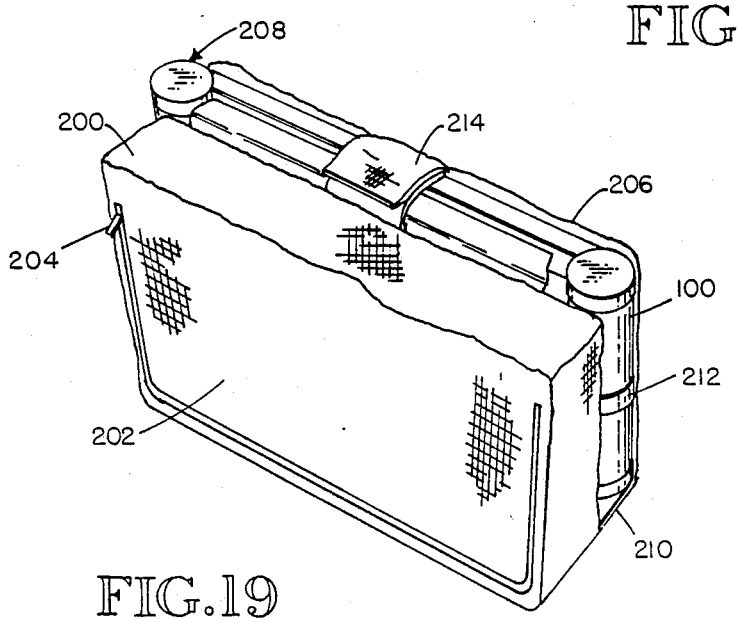
FIG. 21 is a reduced scale perspective view of the playtray of FIG. 12 being carried in a storage saddle bag of the present invention.

As shown in FIG. 21 the invention further includes a saddle bag 200 in which the folded playtray 100 of this second embodiment of the invention may be carried. The saddle bag includes a first storage compartment 202 utilizing a conventional zipper 204 to extend around three sides of the first compartment to provide access to and closure of the first compartment. The first compartment 202 is sized to store Lego-type toys and other articles as desired for use with the playtray 100. The saddle bag 200 includes a second compartment 206 of generally smaller size than the first compartment 202 and also utilizing a zipper (not shown) for access and closure. The first and second compartments 202 and 206 are spaced apart to provide a space 208 therebetween for storage of the folded playtray 100 therein. The compartments 202 and 206 are attached together along their length at the bottom side by a sheet 210 of flexible material extending therebetween and defining a closed side of the space 208 in which the folded playtray is positioned.

The folded playtray 100 is maintained in position in the space 208 by a pair of attachment straps 212 positioned at each end of the folded playtray and which extend between the first and second compartments 202 and 206. Additionally, the straps 212 also maintain the compartments 202 and 206 tied together. A pair of straps 214 are attach to the compartments 202 and 206 at their top side and extend across the top of the space 208 to prevent the folded playtray from moving upward out of the space 208. Each of the pairs of straps 212 and 214 comprise one strap attached to the compartment 202 and another strap attached to the compartment 206 with one strap having a hook-type Velcro patch (not shown), and the other strap having a mating loop-type Velcro patch (not shown).

With the saddle bag 200 of the present invention, the user can store a variety of play things and other materials to be used with the playtray 100 in the compartments 202 and 206, and the folded playtray itself can be stored in the space 208 between the compartments to provide a convenient and compact carrying case for taking the folded playtray and other associated play things on trips, or simply to provide compact storage.

It will be appreciated that, although specific embodiments of the invention have been described herein for purposes of illustration, various modifications may be made without departing from the spirit and scope of the invention. Accordingly, the invention is not limited except as by the appended claims.

We claim:

1. A playtray for use with toys or blocks with at least one attachment surface, comprising:

a table top having first and second end portions and a table play surface with attachment means on said table play surface corresponding to the attachment surface of the toys or blocks for detachably fastening the toys or blocks thereto by their attachment surface;

a first leg having a first leg play surface with attachment means on said first leg play surface corresponding to the attachment surface of the toys or blocks for detachably fastening the toys or blocks thereto by their attachment surface;

first hinge means for pivotally attaching said first leg to said table top first end portion;

a second leg having a second leg play surface with attachment means on said second leg play surface corresponding to the attachment surface of the toys or blocks for detachably fastening the toys or blocks thereto by their attachment surface;

second hinge means for pivotally attaching said second leg to said table top second end portion;

first latch means for latching said first leg against movement relative to said table top in at least first and second leg configurations;

second latch means for latching said second leg against movement relative to said table top in at least said first and second leg configurations, wherein in said first leg configuration each said latch means latches the corresponding one of said legs in a position with said first and second legs extending generally transverse to said table top in a common direction to support said table top with said table play surface uppermost, and wherein in said second leg configuration each said latch means latches the corresponding one of said legs in a position with said first and second legs extending away from said table top in generally opposite directions and in a plane generally parallel with said table top to position said table play surface and said first and second leg play surfaces in generally coplanar arrangement to define an extended play surface.

2. The playtray according to claim 1 wherein said first and second latch means are also for latching said first and second legs to said table top in a third leg configuration, wherein in said third configuration each said latch means latches the corresponding one of said legs in a position with said first and second legs folded inward under said table top with an underside surface of said first and second legs opposite said first and second leg play surfaces, in juxtaposition with an underside surface of said table top opposite said table play surface.

3. The playtray according to claim 1 for use with toys or blocks with the one attachment surface having recesses, wherein said table play surface and said first and second leg play surfaces each include a plurality of nubs aligned in a two-dimensional matrix extending over said play surface mateable with the recesses of the toys or blocks.

4. The playtray according to claim 1 wherein said attachment means of said table play surface and said first and second leg play surfaces, respectively, cover said surfaces such that when said legs are in said second leg configuration said attachment means of said table play surface and said first and second leg play surfaces in combination define a substantially unbroken play surface for detachable fastening of the toys or blocks thereto, said substantially unbroken play surface extending substantially fully between a free end of said first leg and a free end of said second leg.

5. The playtray according to claim 1, wherein said first and second hinge means includes:

a pair of cylindrical hinge portions fixedly attached to each of said first and second end portions of said table top and spaced apart along and in axial alignment with a hinge rotation axis extending transverse to said table top, each said hinge portion having a side wall substantially circular in cross-section with an outwardly open end defined by an outer edge wall and a transverse interior wall spaced inward from said open end, said interior wall having a plurality of apertures therein;

a pair of hinge rings fixedly attached to each of said first and second legs at an end portion thereof and spaced apart along and in axial alignment with said hinge rotation axis, said pair of hinge rings being spaced apart to position said pairs of hinge rings outward of a corresponding pair of said table top hinge portions with an inner edge wall of each said hinge ring in juxtaposition with and substantially contacting a corresponding one of said outer edge walls of said table top hinge portions, said hinge rings and said edge walls of said table top hinge portions having a substantially equal sized wall thickness and diameter; and a connector cap having a sleeve with a substantially circular cross-section, said sleeve having a diameter to fit snugly interior of a corresponding adjacent pair of said hinge ring and table top hinge portion and a length to span said hinge ring and table top hinge portion in the direction of said hinge rotation axis, said connector cap further including an end cover with a generally circular portion in juxtaposition with and substantially contacting an outer edge wall of a corresponding one of said hinge rings to close the interior of said hinge ring, and a plurality of arms positioned inward of said sleeve and extending into said apertures in said transverse interior wall of the corresponding one of said table top hinge portions and grasping said interior wall to hold said connector cap against movement relative thereto, said connector cap and said table top hinge portion holding said hinge ring rotatably therebetween on said sleeve for rotational movement of a corresponding one of said legs about said hinge rotation axis relative to said table top.

6. The playtray according to claim 1, wherein said first and second hinge means includes:

a pair of cylindrical hinge portions fixedly attached to each of said first and second end portions of said table top and spaced apart along and in axial alignment with a hinge rotation axis extending transverse to said table top, each said hinge portion having a side wall substantially circular in cross-section with an edge wall;

a pair of hinge rings fixedly attached to each of said first and second legs at an end portion thereof and spaced apart along and in axial alignment with said hinge rotation axis, said pair of hinge rings being spaced apart to position said pairs of hinge rings adjacent to a corresponding pair of said table top hinge portions with an edge wall of each said hinge ring in juxtaposition with and substantially contacting a corresponding one of said edge walls of said table top hinge portions, said hinge rings and said edge walls of said table top hinge portions having a substantially equal sized wall thickness and diameter;

means for rotatably holding said hinge rings and said table top hinge portions together for rotational movement of a corresponding one of said legs about said hinge rotation axis relative to said table top.

7. The playtray according to claim 1, wherein said first and second latch means includes:

first and second latch grooves formed in each of said first and second end portions of said table top corresponding in position to latch said first and second legs in said first and second leg configurations; and a pair of latches movably attached to each of said first and second legs, each latch having a handle portion positioned at an end portion of the corresponding one of said legs and operable by the user, a catch portion positioned to releasably engage said latch grooves of the corresponding one of said first and second end portions of said table top for selectively locking said legs in said leg configurations and releasing said legs for movement between said configurations, and an extension portion extending between said handle portion and said catch portion for moving said catch portion into and out of said grooves in response to movement of said handle portion.

8. The playtray according to claim 7 wherein said first and second latch means each further include a spring means for biasing said catch portion into said grooves when said handle portion is released by the user.

9. The playtray according to claim 1, wherein said first and second latch means each include means for single-handed operation of said latch means by the user by a handle located remote from said first and second hinge means for the corresponding one of said first or second legs.

10. The playtray according to claim 1, further including an alternative surface member having a first flat side for use by the user and a second opposite side with attachment means corresponding to the attachment means of said table play surface for detachably fastening said alternative surface member to said table play surface with said flat side facing outward, whereby said flat side may be used by the user for writing or playing when a smooth surface is desired.

11. The playtray according to claim 1, wherein each of said first and second legs includes at least one fixed support projecting away from an underside surface thereof to support said legs in an elevated position above a surface on which the playtray is placed when in said second leg configuration substantially equal to the elevated position of said table top.

12. The playtray according to claim 2, wherein each of said first and second legs includes at least one fixed support projecting away from said underside surface thereof to support said legs in an elevated position above a surface on which the playtray is placed when in said second leg configuration substantially equal to the elevated position of said table top, said supports being positioned to engage said underside surface of said table top when in said third leg configuration to define a space between said leg underside surfaces and said table top underside surface of sufficiently large size to avoid pinching of the users fingers therebetween when said legs are moved into said third leg configurations.

13. The playtray according to claim 2, further including a saddle bag, comprising:

a first storage compartment for the toys or blocks;

a second storage compartment for additional materials, said first and second storage compartments being spaced apart to define a space therebetween sized to hold the playtray therein when in said third leg configuration;

a connector member extending between said first and second storage compartments along a lower edge thereof to define a lower extent of said space and to extend below the playtray when in said space, said connector member carrying the weight of the playtray when the saddle bag is lifted and tying said compartments together;

side connector means for releasably connecting the opposing side portions of said storage compartments together and holding the playtray in said space against lateral movement; and top connector means for releasably connecting the top portion of said storage compartments together and holding the playtray in said space against upward movement.

* * * * *